United States Patent [19]

Hautau

[11] Patent Number: 5,029,595

[45] Date of Patent: Jul. 9, 1991

[54] BLASTING APPARATUS

[76] Inventor: Charles M. Hautau, 306 Brookville St., College Corner, Ohio 45003

[21] Appl. No.: 224,665

[22] Filed: Jul. 27, 1988

[51] Int. Cl.[5] ..... B08B 3/02

[52] U.S. Cl. ..... 134/142; 134/148; 134/153; 134/157; 134/200

[58] Field of Search ..... 134/144, 142, 148, 149, 134/153, 157, 200; 118/319, 321; 51/424, 421

[56] References Cited

U.S. PATENT DOCUMENTS

| | | | |
|---|---|---|---|
| 1,762,847 | 6/1930 | Webb . | |
| 1,887,395 | 11/1932 | Billings et al. . | |
| 1,941,915 | 1/1934 | Rosenberger | 51/421 |
| 2,160,697 | 5/1939 | Hamren . | |
| 2,258,634 | 10/1941 | Turnbull . | |
| 2,443,091 | 6/1948 | Zademach . | |
| 2,696,823 | 12/1954 | Scott . | |
| 3,041,787 | 7/1962 | Schnetzer . | |
| 3,060,946 | 10/1962 | Lantz . | |
| 3,133,547 | 5/1964 | Dannenmann et al. . | |
| 3,397,490 | 8/1968 | Carlson . | |
| 3,419,429 | 12/1968 | Zadron et al. . | |
| 3,422,826 | 1/1969 | Ballard . | |
| 3,448,744 | 6/1969 | Szczepanski . | |
| 3,452,763 | 7/1969 | Ballard . | |
| 3,459,891 | 8/1969 | Ladney, Jr. . | |
| 3,504,683 | 4/1970 | Timmer et al. . | |
| 3,516,471 | 6/1970 | Harkins et al. . | |
| 3,656,491 | 4/1972 | Ballard . | |
| 3,675,665 | 7/1972 | Sadwith . | |
| 3,769,750 | 11/1973 | Mayer et al. . | |
| 3,934,374 | 1/1976 | Leliaert . | |
| 4,133,340 | 1/1979 | Ballard . | |
| 4,143,669 | 3/1979 | Minkin . | |
| 4,170,240 | 10/1979 | Gentry . | |
| 4,175,575 | 11/1979 | Cushing . | |
| 4,177,353 | 12/1979 | McCormack . | |
| 4,213,475 | 7/1980 | Minkin . | |
| 4,217,920 | 8/1980 | Ballard . | |
| 4,299,245 | 11/1981 | Clapper . | |
| 4,350,174 | 9/1982 | Bolten et al. . | |
| 4,441,278 | 4/1984 | Covey, III . | |
| 4,665,653 | 5/1987 | Franz et al. . | |
| 4,722,151 | 2/1988 | Westwell . | |
| 4,741,351 | 5/1988 | Minkin . | |

*Primary Examiner*—Frankie L. Stinson

[57] ABSTRACT

A blasting apparatus for spraying a flowable cleaning or treating material onto a part comprises a cabinet having a treating chamber formed with an opening within which a door and base support are rotatably mounted. A part support platform is mounted to the base support on opposite sides of the door so that while one platform is located within the treating chamber for spraying a part it supports, the other platform is located outside of the treating chamber to permit loading and unloading of parts thereon. An inflatable seal is mounted on the periphery of the door or cabinet opening to prevent escape of material from the treating chamber. Independently controlled drive trains are provided to rotate the door between an open and closed position, and to effect rotation of the platforms relative to the door when they are positioned within the treating chamber. A spray head carrying one or more spray nozzles is movable vertically and longitudinally relative to a part within the treating chamber to ensure complete cleaning or treating thereof.

21 Claims, 9 Drawing Sheets

10
12
14
15
16
18
22
30
32
34
48
50
60
64
68
70
92
98
120
128
130
132
134
166
174
176
178
185
196
198
202
204
222
246
247
248
266
276
278
292
298
300
302
3
4

BLASTING APPARATUS

FIELD OF THE INVENTION

This invention relates to blasting apparatus, and, more particularly, to an apparatus for spraying flowable material such as water, steam, sand, or grit onto the surface of a part within a closed treating chamber for cleaning the part.

BACKGROUND OF THE INVENTION

Blasting apparatus are commercially available for cleaning, degreasing, and deburring a wide variety of manufactured parts. Typical prior art blasting apparatus include a cabinet having a treating chamber into which a part mounted on a part support is conveyed for cleaning or deburring by a high pressure stream of water, steam, sand, grit, etc. discharged from sprayers located within the treating chamber. The construction of apparatus of this type includes a mechanism for moving the parts in and out of the treating chamber, a door or other structure for sealing the chamber once the parts are placed therein and spraying devices for discharging the cleaning material onto the parts in the treating chamber. Each of these features of prior art blasting apparatus, depending upon the particular design, have presented problems or limitations in operation.

Several different designs have been proposed to move parts in and out of the treating chambers of blasting apparatus. For example, in one type of apparatus a cabinet having a treating chamber is formed with an opening within which a door is mounted having a part support on its inner side. The door is placed in an open position to receive a part to be treated and then closed to place the part within the treating chamber for cleaning. Once the cleaning operation is completed the door is reopened to remove the treated part and replace it with another. See, for example, U.S. Pat. Nos. 4,213,475; 3,934,374; 4,143,669; 3,041,787; and, 4,741,351.

The problem with apparatus of this type is that the cleaning or blasting procedure is essentially a "batch" operation. That is, the apparatus must be shut down to both load a part onto the part support, and then, after the part is cleaned, to remove the clean part and replace it with another to be cleaned. This procedure is inefficient and involves a substantial amount of downtime of the machine as the parts are moved on and off the part support.

Another approach in the prior art for moving parts in and out of the treating chamber of a blasting apparatus involves the use of a turntable having a number of part supports along the circumference thereof which are movable in and out of the treating chamber by the rotation of the turntable. See, for example, U.S. Pat. Nos. 1,887,397 and 2,160,697. Alternatively, conveyors are employed which move parts continuously through a treating chamber. See U.S. Pat. No. 3,675,665. The use of a turntable or conveyor to move parts in and out of a treating chamber avoids some of the operating delays associated with the apparatus described above wherein a single part support is alternately moved in and out of a treating chamber. A number of parts can be supported on a turntable or a conveyor and the blasting apparatus is not shut down when the parts enter or leave the treating chamber.

One disadvantage of blasting apparatus having continuously movable turntables and/or conveyors is that it is difficult and possibly dangerous to load and unload parts while the part support is moving. Particularly where the parts to be treated are bulky and/or heavy, it is undesirable to attempt to remove a cleaned part from a support on rotating turntable or moving conveyor, and then replace it with a part to be treated before the turntable or conveyor moves the part support back into the treating chamber.

Another aspect of blasting apparatus is the creation of a seal at the entrance to the treating chamber to avoid the loss of water, steam or particulate blasting material into the environment during a blasting operation. This has been a particular problem in apparatus of the type described above wherein the parts are continuously movable in and out of the treating chamber because a dynamic seal must be created between the support for the parts and the entrance to the treating chamber.

In the prior art, flexible flaps or curtains have been used in an attempt to create a seal between a moving part support and the entrance to the treating chamber such as shown, for example, in U.S. Pat. Nos. 1,887,395 and 2,258,634. These types of seals are relatively ineffective in preventing the escape of material into the atmosphere and cannot create a fluid-tight seal of the treating chamber. Although a recovery system could be employed within the treating chamber, e.g., a vacuum/-filter system to create a negative pressure therein and draw the cleaning material toward the base of the treating chamber, such a feature would add substantial expense to the blasting apparatus.

Another aspect of blasting apparatus is to ensure that the cleaning material sprayed onto the parts within the treating chamber completely covers the parts to remove all dirt, grease, burrs, etc. Prior art designs have included mechanisms for rotating or tilting the part support relative to spray devices, for moving the spray devices with respect to the part support and/or some combination of part support and sprayer movement. In many prior art apparatus, the mechanisms for moving the sprayers and/or the part supports are positioned within the treating chamber and are exposed to the water, steam, sand or grit employed to clean the part. See, for example, U.S. Pat. Nos. 2,160,697; 3,309,818; and, 4,299,245. The problem with this design is that the mechanisms can become worn and/or fouled with the cleaning material causing downtime of the blasting apparatus, and added expense for the repair or replacement of such mechanisms.

SUMMARY OF THE INVENTION

It is therefore among the objectives of this invention to provide a blasting apparatus for the treatment of parts which provides for essentially continuous treatment of parts while ensuring operator safety, which retains the cleaning or treating material within the treating chamber thereof and which ensures complete coverage of the part with treating material without damaging the drive mechanisms associated with the part support and/or material sprayers.

These objectives are accomplished in a blasting apparatus which comprises a cabinet having a treating chamber formed with an opening which mounts a rotatable door. The door is carried atop a base support which mounts at least one first part support platform on one side of the door and at least one second part support platform on the opposite side of the door. The door and base support are rotatable with respect to the cabinet opening so that one of the part support platforms is located within the treating chamber while the other part support platform is located outside of the treating chamber. An inflatable seal is carried either in the wall of the cabinet at the door opening, or on the periphery of the door, to create a fluid-tight seal therebetween during a treating operation. Movable sprayers are located within the treating chamber, and both part support platforms are rotatable when positioned within the chamber, to ensure complete coverage of a part supported thereon by treating material discharged from the sprayers.

One aspect of this invention is predicated upon the concept of providing for essentially continuous operation of the blasting apparatus herein without creating potential operator safety hazards, or loading/unloading problems, associated with the placement or removal of parts from either of the part support platforms carried by the base support of the door. In the presently preferred embodiment, at least one part support platform is located on opposite sides of the door so that one platform is placed within the interior of the treating chamber while the other platform is located exteriorly thereof. Drive mechanisms extending from the cabinet, through the door and into the base support carrying the platforms are operable independently of one another to control the door movement and the rotation of each part support platform.

In operation, the part support platform within the treating chamber is rotated to expose all sides of the part to the material discharged from sprayers located within the treating chamber. The part support platform located exteriorly of the treating chamber is held stationary by disengagement of its drive means, and by a locking pin extending between the base support and platform, so that a part previously treated in the treating chamber can be safely and easily removed therefrom and a new part placed onto such part support platform while the part within the chamber is being treated.

When the treatment of a part within the treating chamber is completed, the door and base support are rotated to move the treated part out of the treating chamber and place the part support platform carrying the new part to be treated into the treating chamber. The cleaning operation is then immediately resumed within the treating chamber while the newly treated part is being removed from the part support platform on the outside of the treating chamber and a new part to be treated is placed thereon. As a result, the cleaning or treating operation performed by the blasting apparatus of this invention is essentially continuous. Moreover, the placement and removal of a part onto the part support platforms is accomplished exteriorly of the treating chamber and without any movement of the part support platform to ensure operator safety.

In the presently preferred embodiment, the drive mechanisms for rotation of the door, and for rotation of each part support platform, are operated independently of one another by a programmable logic controller. One motor drives a sprocket connected to the door for rotation of the door and base support 180° so that each part support platform on opposite sides of the door can be alternatively moved into and out of the treating chamber of the cabinet. The part support platforms are driven by a second motor connected to a pair of clutches, one for each of the platforms. A separate drive train of interconnected sprockets, shafts and timing belts is provided for each of the part support platforms which extends from the top of the cabinet, through the door and into the base support which mounts the part support platforms. These drive mechanisms are isolated from the environment of the treating chamber within both the door and the base support so that the spraying operation does not damage or wear any of their moving parts.

Another aspect of this invention involves the discharge of a cleaning material such as water, steam, grit, sand or the like onto the entire surface of a part within the treating chamber. A spray head having one or more spray nozzles is located within the treating chamber and mounted at one end of a spray column. The spray column, in turn, is carried by a vertical support column and a horizontal base which are operable to move the spray column and spray head both vertically and longitudinally with respect to a part mounted on the part support platform within the treating chamber.

In the presently preferred embodiment, the spray column is driven by a rack and pinion along rollers carried on the support column to obtain vertical movement of the spray head within the treating chamber. The spray column and spray head are movable longitudinally along a slot formed in the top of the cabinet by rotation of a motor driven threaded shaft connected to the horizontal base. The horizontal base is carried on a pair of rails extending longitudinally atop the cabinet. The support column mounts a seal which is movable therewith and covers the slot in the top of the cabinet as the support column and horizontal base move therealong.

DESCRIPTION OF THE DRAWINGS

The structure, operation and advantages of a presently preferred embodiment of this invention will become further apparent upon consideration of the following description, taken in conjunction with the accompanying drawings, wherein.

DETAILED DESCRIPTION OF THE INVENTION

Referring now to the Figs., a blasting apparatus 10 is illustrated which is effective to spray a cleaning material such as water, steam, grit, sand, etc., or a coating material, onto a part to be treated. The various features of the apparatus 10 including the cabinet and door construction, the drive mechanisms for the door and part support platforms and the material spraying device, are described separately below.

CABINET AND DOOR

Figure 1:
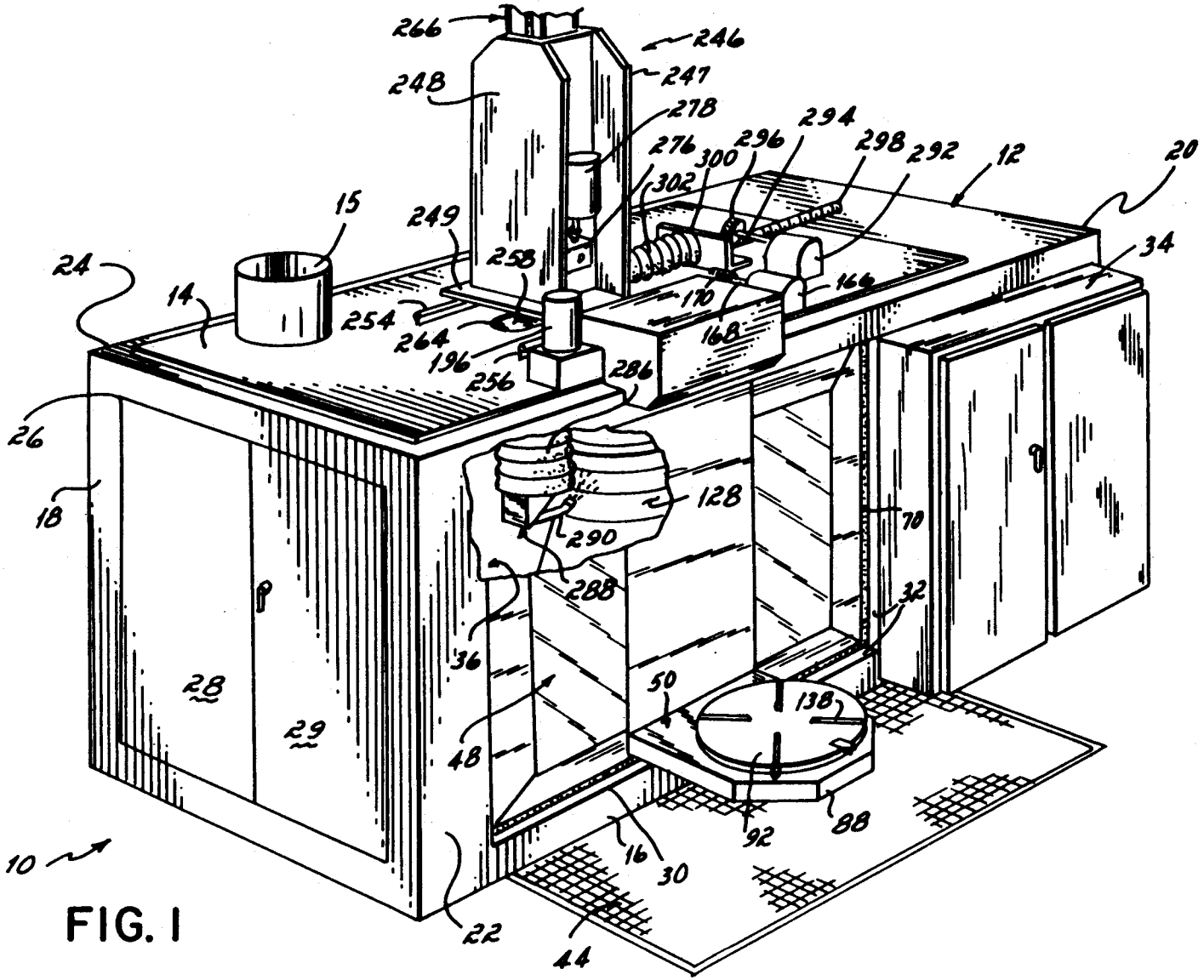
FIG. 1 is a perspective view of a blasting apparatus of this invention.
Figure 2:
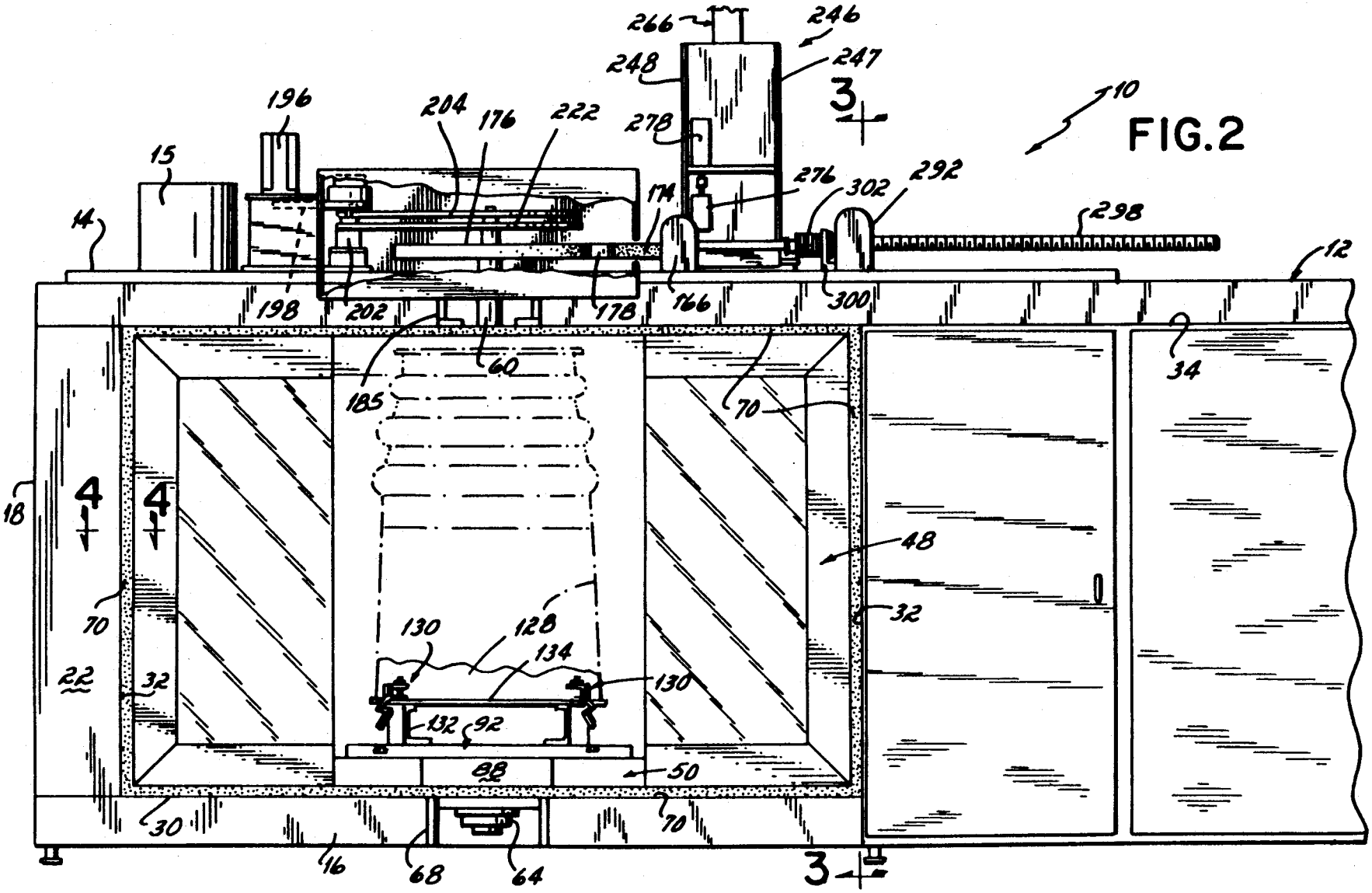
FIG. 2 is a fragmentary front view of the blasting apparatus.

Referring now to FIGS. 1-6, the blasting apparatus 10 includes a cabinet 12 having a top wall 14 with a vent fan 15, bottom support beams 16, 17, opposed end walls 18, 20 and opposed side walls 22, 24. As shown in FIG. 1, the end wall 18 is formed with an opening 26 which mounts a pair of doors 28, 29, and the side wall 22 is formed with an opening 30 defining a door jamb 32. A controller 34 is mounted to the side wall 22 which controls the operation of blasting apparatus 10 and includes commercially available programmable logic controllers. The programmable logic controllers form no part of this invention per se and are thus not described in detail herein.

Figure 3:
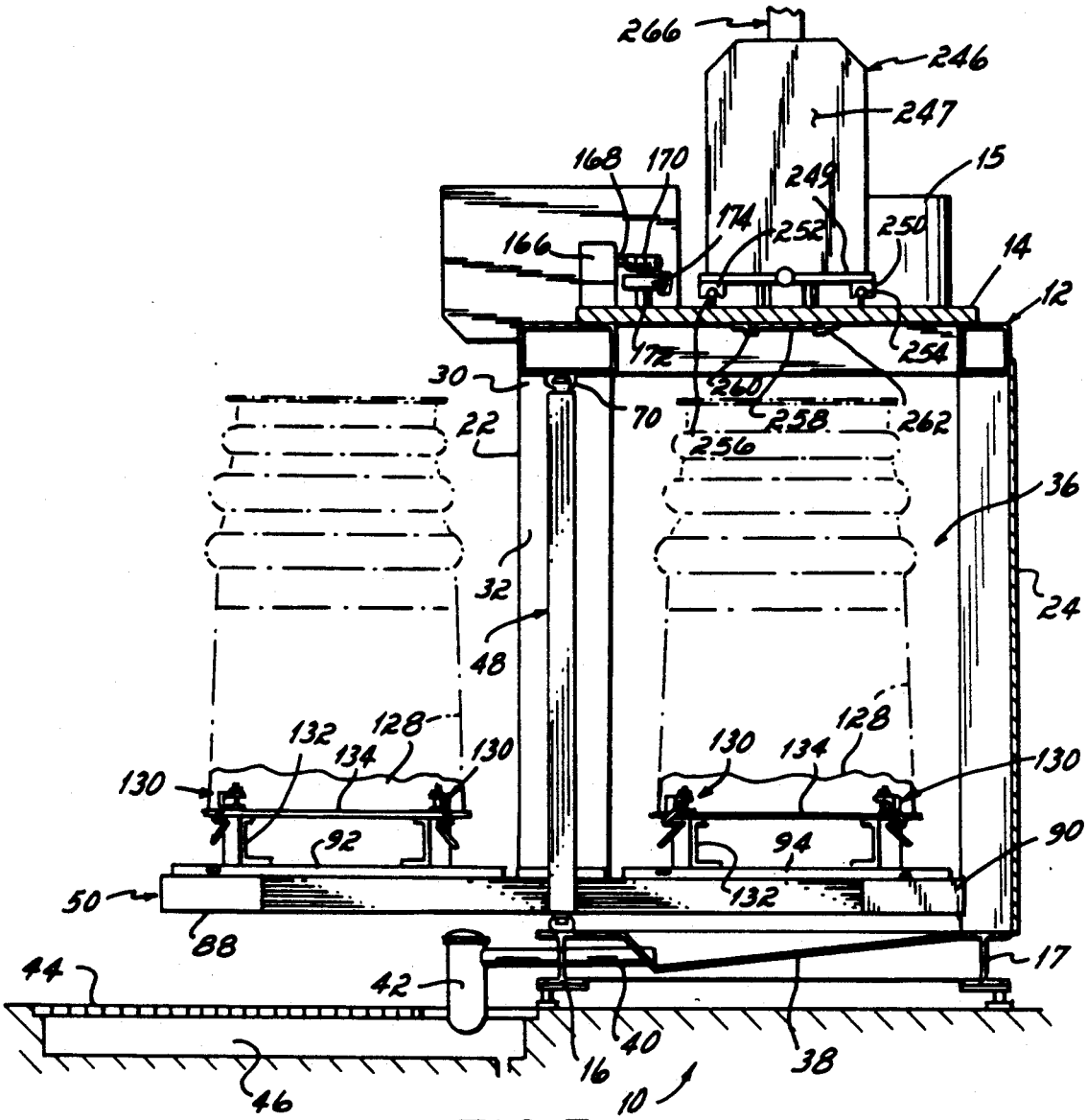
FIG. 3 is a cross sectional view taken generally along lines 3—3 of FIG. 2.

As shown in FIG. 3, the interior of the cabinet 12 forms a treating chamber 36 having a tapered floor 38 which leads to a drainpipe 40. The drainpipe 40 is connected to a filter 42 for removal of contaminants from the cleaning material used during a cleaning operation as discussed below. An optional floor extension 44 (formed in the floor of the building) exteriorly of the cabinet 12 adjacent the opening 30 in side wall 22 which includes a drip pan 46. See also FIGS. 1 and 7.

A hollow door 48 is mounted in the opening 30 of side wall 22 atop a base support 50. As shown in more detail in FIGS. 8 and 9, a center section 52 of the base support 50 is hollowed out and a mounting flange 54 is connected to the base support 50 over a portion of such center section 52 by a number of bolts 56. The bottom of the door 48 is welded to the mounting flange 54 as at weldments 58, 59, and is thus secured to the base support 50. The upper end of door 48 is connected to an outer drive sleeve 60 carried by the top wall 14 of cabinet 12 as described in detail below in connection with the drive mechanisms of this invention.

Figure 8:
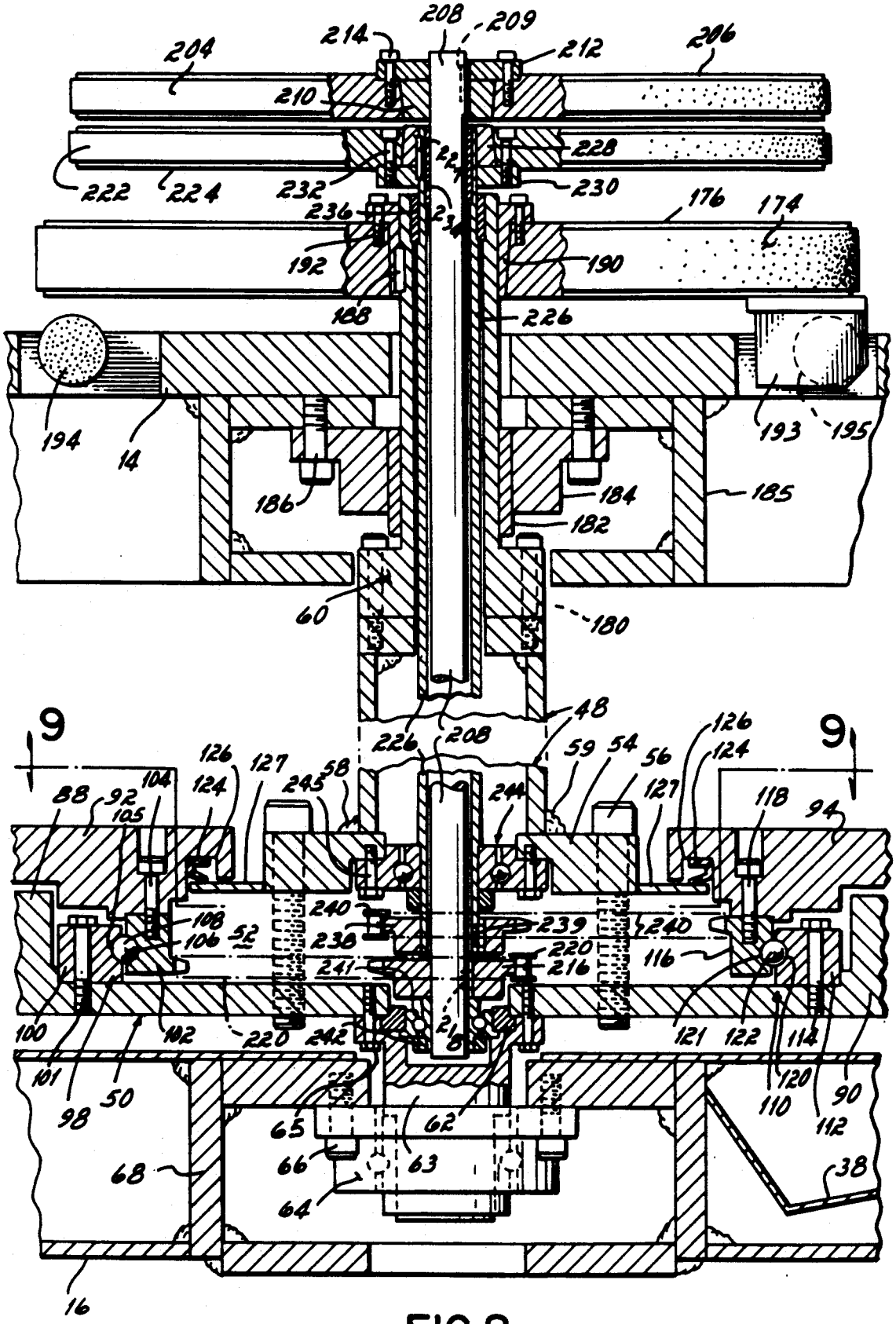
FIG. 8 is a cross sectional view taken generally along lines 8—8 of FIG. 7 illustrating the drives for the door and part support platforms. The part support platforms are shown rotated 90° with respect to their position of FIG. 7 for clarity of illustrating the drive to the platforms.

As shown at the bottom of FIG. 8, the base support 50 is rotatably mounted upon a stub shaft 63 rotatably carried by a ball bearing unit 64. The ball bearing unit 64 is mounted by bolts 66 to a support frame 68 carried at the base 16 of side wall 22 immediately beneath the opening 30 therein. The stub shaft 63 is mounted by screws 65 to the underside of base support 50, and supports a mounting ring 62. Preferably, the stub shaft 63 is formed with a lubricant passageway (not shown) to provide lubricant to the drive mechanisms carried in the door 48 and base support 50 as described below.

As described in detail below, the door 48 and base support 50 are rotatable with respect to the opening 30 in side wall 22. In order to perform a blasting or coating operation within treating chamber 36, a fluid-tight seal is preferably made between the periphery of door 48 and the door jamb 32 in side wall 22 to prevent the escape of treating material to atmosphere. This seal is accomplished by the structure illustrated in FIGS. 4 and 4A.

Figure 4:
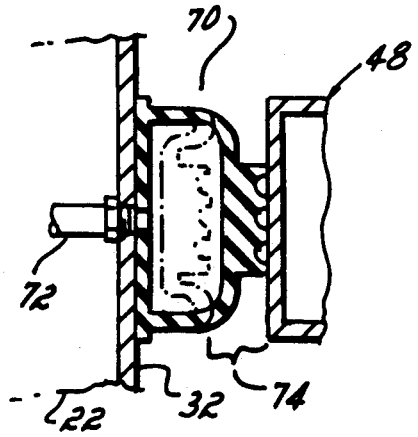
FIG. 4 is a cross sectional view taken along lines 4—4 of FIG. 2 illustrating one embodiment of the door seal herein.

Referring first to the embodiment of FIG. 4, an inflatable seal 70 is mounted around the periphery of door jamb 32 and connected by a supply line 72 extending through side wall 22 to a source of pressurized air (not shown). The inflatable seal 70 is movable between a retracted, deflated position shown in phantom in FIG. 4 wherein a gap 74 is formed between the door jamb 32 and door 48, and an extended, inflated position shown in solid lines in FIG. 4 wherein the seal 70 contacts the door 48 forming a fluid-tight seal around its entire peripheral edge. The programmable logic controller 34 is operable to inflate and deflate the seal 70 depending upon the position of door 48 relative to door jamb 32.

Figure 4A:
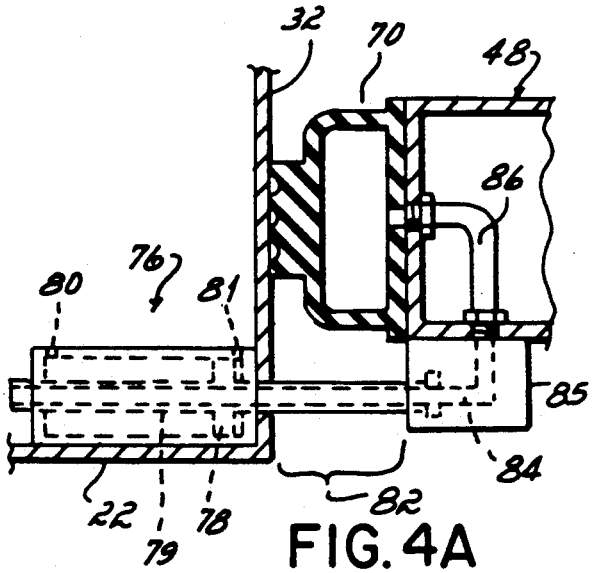
FIG. 4A is a view similar to FIG. 4 showing an alternative door seal mounting arrangement.

In an alternative embodiment shown in FIG. 4A, the inflatable seal 70 is mounted to the periphery of the door 48 instead of the door jamb 32. In this embodiment, a cylinder 76 having a reciprocating piston 78 carrying a hollow pin 79 is mounted in the side wall 22 of cabinet 12 at the door jamb 32. When the door 48 is positioned in a closed position relative to the side wall 22, the controller 34 is operable to direct pilot air through a port 80 formed in the cylinder 76 rearwardly of piston 78. The piston 78 is thus moved to the right as shown in FIG. 4A to extend the hollow pin 79 across the space 82 between the door jamb 32 and door 48 and into engagement with a passageway 84 formed in a block 85 mounted to the door 48. This passageway 84 is connected to an air line 86 within door 48 which terminates at the inflatable seal 70. In order to inflate the seal 70 as shown in FIG. 4A, pressurized air is directed through the hollow pin 79, through passageway 84 and into passageway 86 connected to seal 70. When it is desired to rotate door 48, the flow of pressurized air is terminated by controller 34 and pilot air is introduced into the cylinder 76 through port 81 forwardly of the piston 78 to retract the piston 78 and pin 79 to a position at least flush with the door jamb 32.

Referring now to FIGS. 1-3, 7 and 8, the base support 50 has a first end 88 and a second end 90, located on opposite sides of door 48, which are adapted to rotatably support a first part support platform 92 and a second part support platform 94, respectively.

Figure 9:
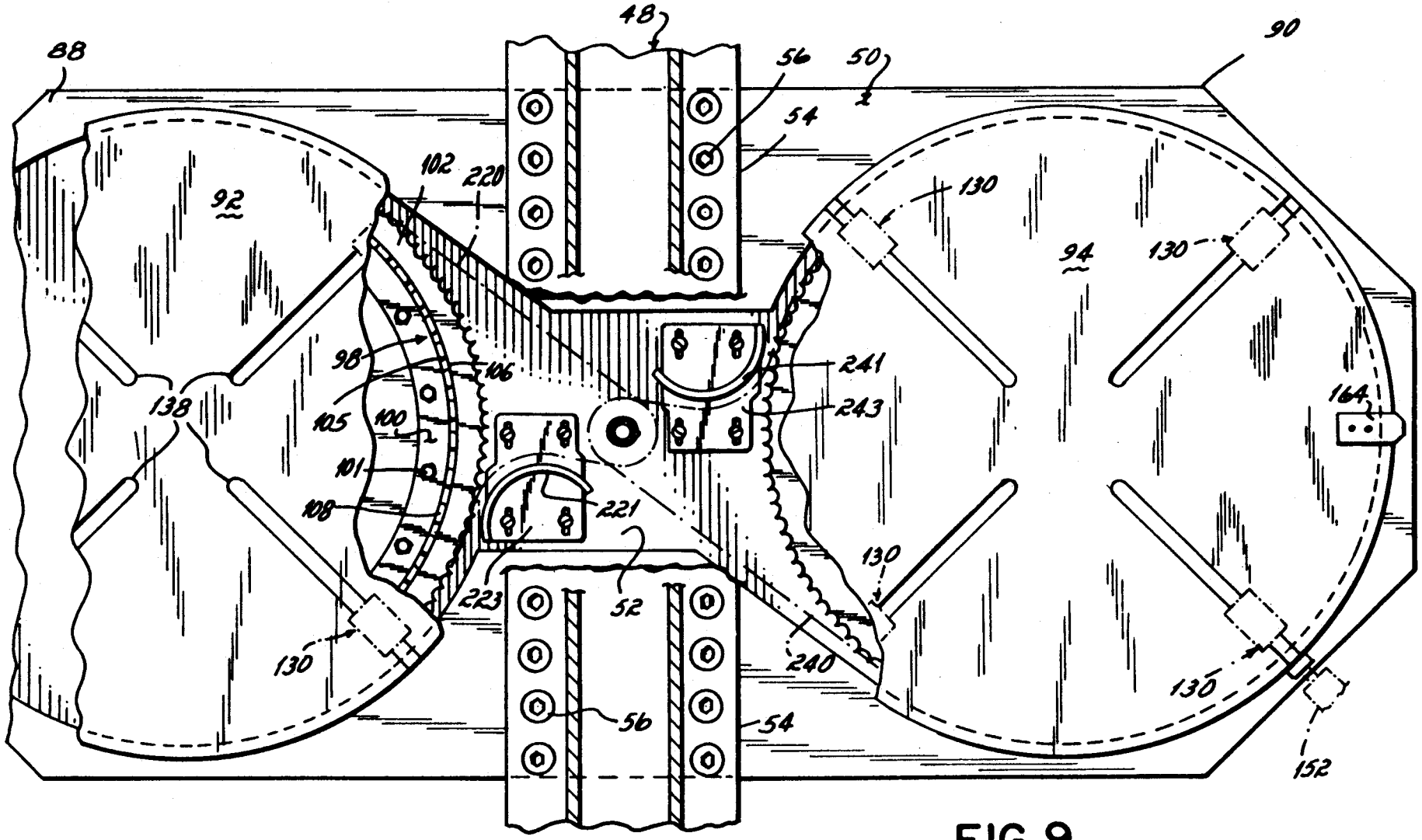
FIG. 9 is a view of the part support platforms, and a portion of the drive therefor, as seen along lines 9—9 of FIG. 8.

As shown on the lefthand side of FIG. 8 and in FIG. 9, the first part support platform 92 is carried on a bearing 98 formed by an annular-shaped block 100 mounted by spaced bolts 101 to base support 50, and a driven sprocket 102 connected by screws 104 to the underside of first part support platform 92. The outer edge of the block 100 forms the inner race 105 of bearing 98 and the inner edge of driven sprocket 102 forms the outer race 106 of the bearing 98 with the balls 108 being captured therebetween. Similarly, the second part support platform 94 is mounted to base support 50 by a bearing 110 identical to bearing 98 which comprises an annular block 112 connected by bolts 114 to base support 50, and a driven sprocket 116 connected by screws 118 to the underside of second part support platform 94. The facing edges of block 112 and driven sprocket 116 form the inner and outer races 120, 121, respectively, of bearing 110 which capture balls 122 therebetween.

As described in detail below, the first and second part support platforms 92, 94 are rotatable with respect to the door 48 and base support 50 independently of one another. In order to seal the center portion 52 of base support 50 to protect the drive mechanisms for rotating platforms 92, 94 from exposure to the environment within treating chamber 36, a seal 124 is carried in a recess 126 at the outer edge of each platform 92, 94. These seals extend from the platforms 92, 94 onto the top surface of a pair of sealing plates 127 each having an annular opening. These plates 127 are fixed to the top of plate 50. See also FIG. 5.

Figure 6:
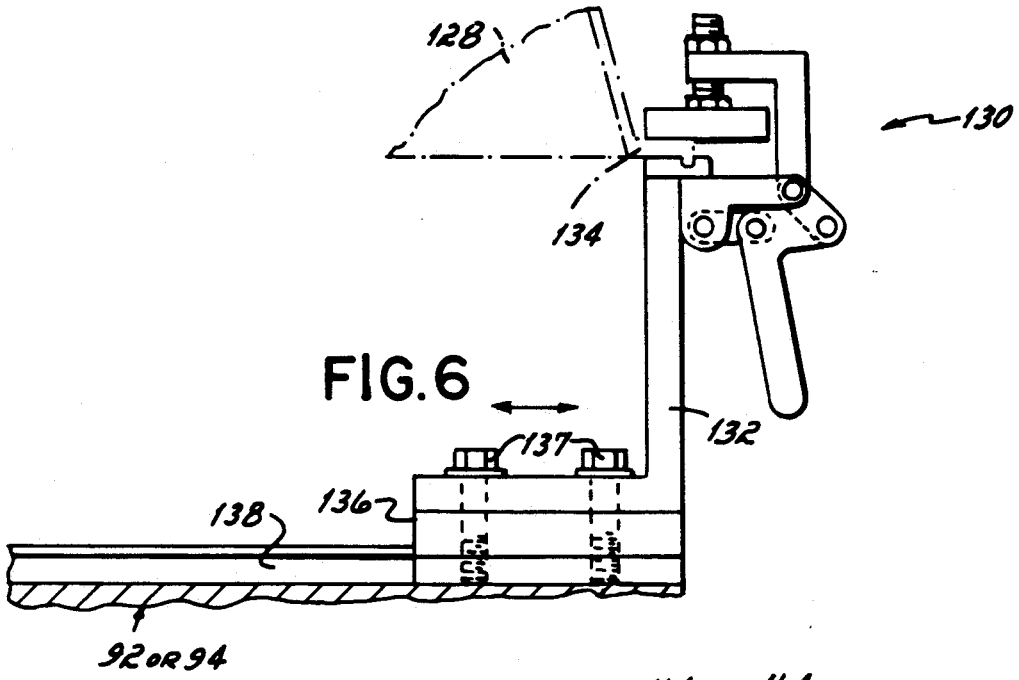
FIG. 6 is a fragmentary view illustrating a typical clamp for securing a part to the part support platform.

Referring again to FIGS. 1-6, the first and second part support platforms 92, 94 each support a part 128 thereon for treatment within the treating chamber 36 of cabinet 12. The parts 128 are secured atop each platform 92, 94 by four toggle clamps 130 located at 90° intervals about the platforms 92, 94. As shown in FIG. 6, each toggle clamp 130 is carried on an L-shaped bracket 132 in position to engage an edge 134 of part 128. The base 136 of each bracket 132 is movable along a T-shaped track 138 formed in the top of the part support platforms 92, 94 so that the toggle clamps 130 can be spaced at different radial distances from the center of the platforms 92, 94 to accommodate parts of varying diameter or transverse dimension. Locking bolts 137 extend through the base 136 to frictionally secure the bracket 132 in track 138 and in place atop platforms 92, 94.

Figure 7:
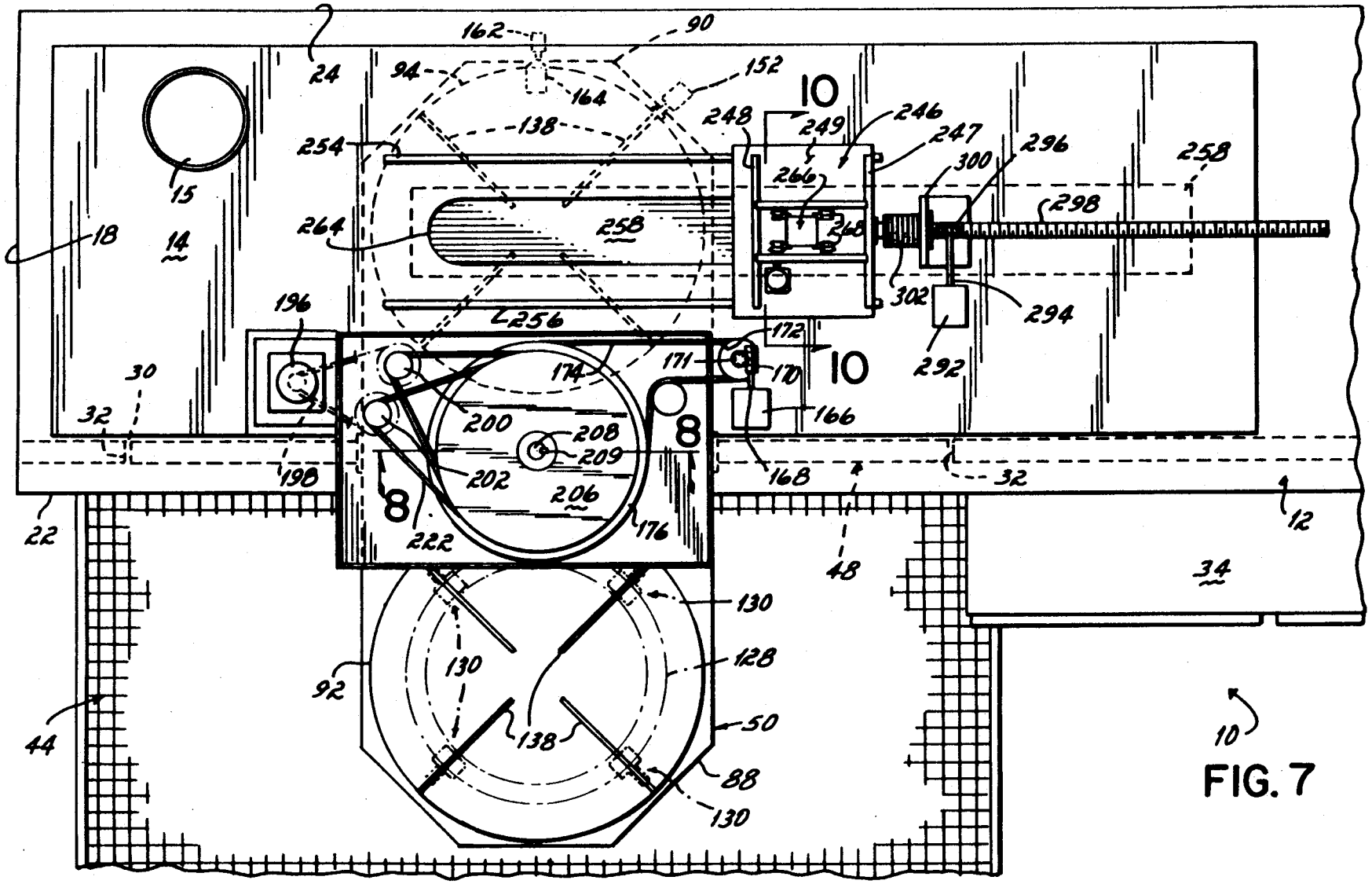
FIG. 7 is a fragmentary top view of the blasting apparatus.

Another feature of this invention is directed to a platform locking mechanism which has the dual purpose of locking each of the part support platforms 92, 94 from rotation relative to the door 48 and base support 50; and, for permitting unimpaired movement of the platforms 92, 94 in and out of the treating chamber 36. With the bracket 132 in its radially outermost position relative to the platforms 92, 94, as shown in FIG. 6, it is conceivable that interference might occur between the door jamb 32 and the toggle clamps 130 if any of the toggle clamps 130 were left in an extended or unlocked position. In order to avoid interference between the toggle clamps 130 and door jamb 32, without making the opening 30 in side wall 22 overly large, structure is provided to locate the platforms 92, 94 with their slots or tracks 138 oriented as shown in FIGS. 1 and 7 and lock them in such position. With the tracks 138 in this position, i.e., at 45° relative to an axis parallel to the side wall 22, the toggle clamps 130 cannot interfere with the door jamb 32.

Figure 5:
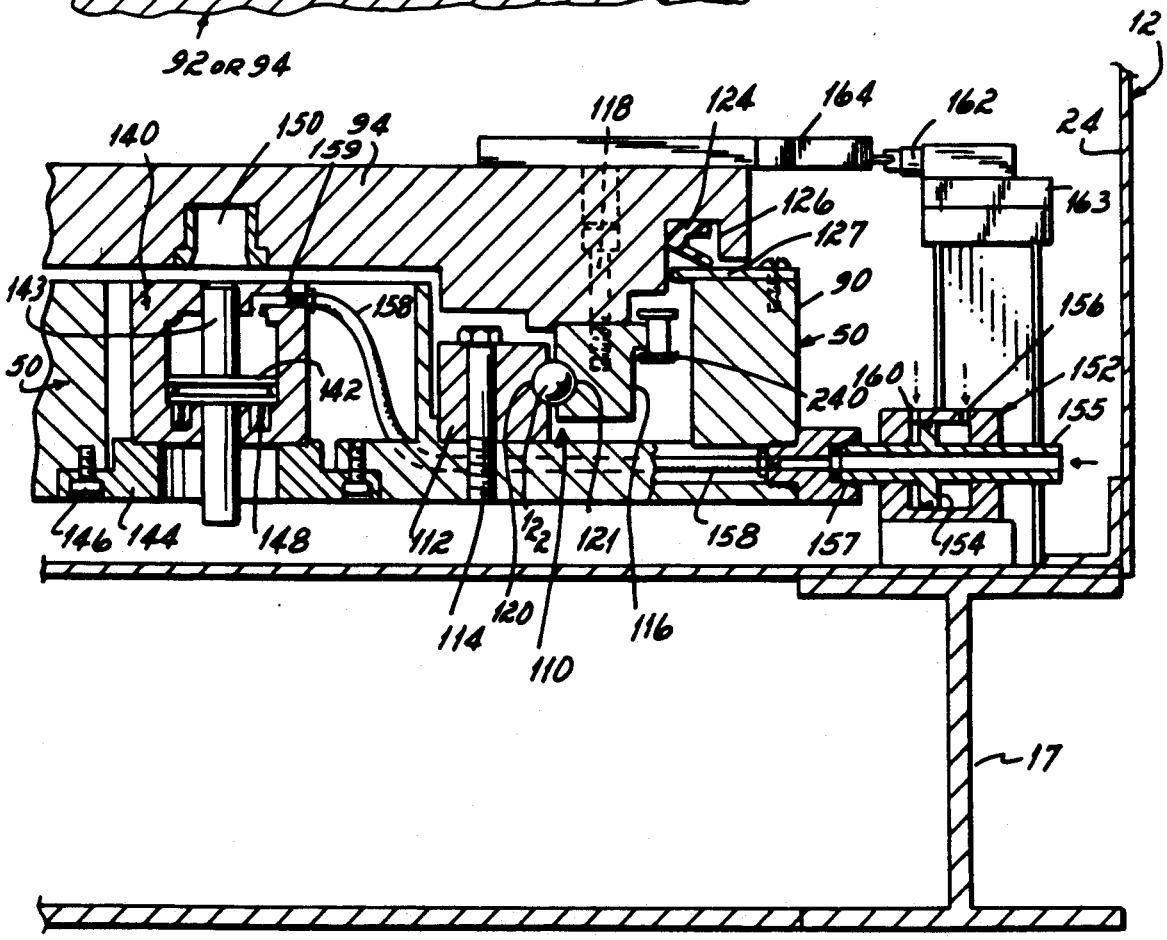
FIG. 5 is a fragmentary cross sectional view illustrating the mechanism for locking and releasing the part support platform for rotation, the mechanism being shown in the released position.

The structure for properly orienting and then locking the part support platforms 92, 94 in preparation for moving them in or out of treating chamber 36 is illustrated in FIG. 5. Referring to the lefthand side of FIG. 5, cylinder 140 having a piston 142 carrying a locking pin 143 is mounted to a support 144, which, in turn, is connected by screws 146 to the underside of base support 50. The piston 142 is movable upwardly to place the locking pin 143 in an extended, platform locking position by operation of a spring 148 carried within the interior of cylinder block 140. In this extended position (not shown), the locking pin 143 seats within an opening 150 formed in the base of platform 94 to lock the platform 94 in a fixed position relative to base support 50. It is to be understood that an identical structure is provided in first end 88 of plate 50 for platform 92.

The locking pin 143 is moved from the extended position to a retracted position upon operation of a cylinder 152 mounted within the treating chamber 36, as viewed on the righthand side of FIG. 5. The cylinder 152 has a reciprocating piston 154 which carries a hollow pin 155. In response to the flow of pilot air through port 156 of cylinder 152, the piston 154 and pin 155 are moved to the left as viewed in FIG. 5 so that the outer end of pin 155 engages a port 157 formed in the base support 50. An air line 158 extends from the port 157 in base support 50 to a port 159 formed in the upper end of the cylinder block 140. Pressurized air is directed through the hollow pin 155, port 157 and air line 158 to the top of cylinder block 140 which forces the piston 142 downwardly thus moving the pin 143 downwardly disengaging the locking pin 143 from the opening 150 in part support platform 94. This permits free rotation of the part support platform 94 with respect to the base support 50 within the treating chamber 36. In order to return the pin 143 to its extended position, pilot air is directed through port 160 at the front of piston 154 in cylinder 152 to retract the pin 155 and thus stop the flow of pressurized air through air line 158. This permits spring 148 to return the pin 143 to its extended position.

The operation of cylinder 152 is controlled, in part, by a limit switch 162 mounted on a platform 163 within the treating chamber 36. The limit switch 162 is positioned relative to the part support platforms 92 and 94 such that when one of the platforms 92, 94 is rotated into position within treating chamber 36, a trip arm 164 mounted thereon contacts the limit switch 162. The limit switch 162 sends a signal to the controller 34 which, in turn, directs pilot air through the port 156 to retract pin 143 as described above.

When the operation within treating chamber 36 has been completed, the controller 34 is operable to direct pilot air through the port 160 in cylinder 152 to retract the piston 154 and pin 155 thus depressurizing cylinder block 140. The spring 148 then forces the locking pin 143 of cylinder 140 upwardly into engagement with the bottom surface of part support platform 94 which continues to rotate until the opening 150 therein aligns with and engages the locking pin 143. In this locked position, each of the tracks 138 on the surface of part support platform 94 are oriented as viewed in FIGS. 1 and 7 thus permitting the removal of the part support platform 94 from the treating chamber 36 without danger of interference between the toggle clamps 130 and the door jamb 32 in side wall 22. Moreover, the part support platform 94 is prevented from rotating relative to the base support 50 to facilitate loading and unloading of parts 128 thereon.

DOOR AND PLATFORM DRIVE MECHANISMS

Referring now to FIGS. 2 and 7-9, the drive mechanisms for rotating door 48 and part support platforms 92, 94 independently of one another are illustrated in detail.

The drive mechanism for the door 48 comprises a motor 166 mounted on the top wall 14 of cabinet 12 which has an output shaft 168 carrying a screw 170. The screw 170 meshes with teeth of a worm gear 171 carried on a common shaft (not shown) with a drive sprocket 172. The drive sprocket 172 is connected by a timing belt 174 to a timing sprocket 176 mounted on the outer drive sleeve 60 mentioned above. Preferably, an idler sprocket 178 engages the timing belt 174 midway between sprockets 172, 176 to maintain the proper tension therein.

As best shown in FIG. 8, the outer drive sleeve 60 is mounted by bolts 180 to the top of door 48. The outer drive sleeve 60 extends upwardly from the door 48 through the top 14 of cabinet 12 where it is rotatably mounted thereto by a journal 182 carried by a journal housing 184. The journal housing 184, in turn, is mounted by bolts 186 to the top 14 of cabinet 12. Preferably, the journal housing 184 is contained within a frame 185 mounted to the underside of the top wall 14.

The timing sprocket 176 is mounted to the upper end of outer drive sleeve 60 by a key 188 and a wedge lock 190 secured by screws 192 to the timing sprocket 176. In response to operation of the motor 166, the drive sprocket 172 drives the timing belt 174 and timing sprocket 176. In turn, the timing sprocket 176 rotates the outer drive sleeve 60 which rotates the door 48 and the base support 50 connected thereto. The controller 34 controls the operation of motor 166 such that the door 48 and base support 50 are first rotated 180° in one direction to place either the first or second part support platforms 92, 94 into the treating chamber 36. Once a treating operation is completed, the controller 34 then operates motor 166 to rotate door 48 and base support 50 in the opposite direction to place the other of the first and second part support platforms 92, 94 into the treating chamber 36. Stops 194, 195 are mounted at the top 14 of cabinet 12 in position to engage a flange 193 mounted on sprocket 176 when the door 48 is rotated to a closed position with either of the platforms 92, 94 in treating chamber 36 to ensure that the door 48 is properly in place relative to the door jamb 32.

The part support platforms 92, 94 are rotated independently of one another by the same motor 196. Referring to the top of FIGS. 2 and 7, the drive train for first part support platform 92 includes the motor 196 which is connected by a timing belt 198 to a timing sprocket and clutch assembly 200. The sprocket portion of the timing sprocket and clutch assembly 200 is connected to a timing belt 204 which extends around a timing sprocket 206 carried on a drive shaft 208. As shown in FIG. 8, the drive shaft 208 is concentrically disposed within the outer drive sleeve 60 and extends from a point above the top 14 of cabinet 12, through the door 48 below the base support 50. The timing sprocket 206 is mounted to drive shaft 208 by a key 209, a wedge 210 and a cover plate 212 extending over the wedge 210 and mounted to the timing sprocket 206 with screws 214. The clutch portion of the timing sprocket and clutch assembly 200 is effective to drivingly connect the timing belt 198 and timing belt 204 so that the timing sprocket 206 and drive shaft 208 are rotatable with the output of motor 196.

Referring now to the bottom portion of FIG. 8, the drive shaft 208 mounts a drive sprocket 216 which is connected thereto by a key 218. The drive sprocket 216 is drivingly connected by a chain 220 to the driven sprocket 102 of part support platform 92. Preferably, a guide 221 mounted by a bracket 223 to the base support 50 is positioned between the sprockets 102, 216 to maintain the proper tension on the chain 220. See FIG. 9. As described above, the driven sprocket 102 is rotatable with respect to the base support 50 on bearing 98 and connected to the part support platform 92 by screws 104 so that rotation of the driven sprocket 102 results in rotation of the first part support platform 92 with respect to the base support 50.

Referring again to the top of FIG. 2 and FIGS. 7 and 8, the drive mechanism for the part support platform 94 is illustrated. A second timing sprocket and clutch assembly 202 is also connected to the timing belt 198 from the motor 196. A timing belt 222 extends from the sprocket portion of the sprocket and clutch assembly 202 to a timing sprocket 224 mounted to an inner drive sleeve 226. The timing sprocket 224 is secured to the inner drive sleeve 226 by a key 227, a wedge 228 and a cover plate 230 which is positioned below the wedge 228 and mounted to the timing sprocket 224 by screws 232. The inner drive sleeve 226 is concentrically disposed around the drive shaft 208 and within the outer drive sleeve 60. A journal 234 is interposed between the inner drive sleeve 226 and drive shaft 208, and a second journal 236 is interposed between the inner drive sleeve 226 and outer drive sleeve 60, to permit relative rotation therebetween. In response to operation of the clutch portion of the timing sprocket and clutch assembly 202, the timing belt 222 drivingly interconnects the timing sprocket 224 with the drive of motor 196 to rotate the inner drive sleeve 226.

As viewed in FIG. 8, the inner drive sleeve 226 extends from above the top wall 14 of cabinet 12 downwardly through the hollow door 48 and into the center portion 52 of base support 50. The bottom end of inner drive sleeve 226 mounts a drive sprocket 238 which is secured thereto by a key 239. The drive sprocket 238 is connected by a chain 240 to the driven sprocket 116 which is fixedly mounted by screws 118 to the second part support platform 94 and is rotatable on the bearing 110 relative to base support 50. In response to rotation of the inner drive sleeve 226, the drive sprocket 238 rotates the driven sprocket 116, and, in turn, the second part support platform 94 relative to the base support 50. As illustrated in FIG. 9, proper tension is maintained on the chain 240 by a guide 241 mounted on a bracket 243 secured to the base support 50.

In the presently preferred embodiment, the lowermost end of drive shaft 208 is mounted to a bearing 241 supported on the base support 50 by the mounting ring 62, and a lock ring 242 is connected to drive shaft 208 beneath the bearing 241. The lowermost end of inner drive sleeve 226 is mounted to a bearing 244 secured by screws 245 to the mounting flange 54 at the base of door 48 to permit rotation of the inner drive sleeve 226 relative thereto.

The drive mechanisms for the door 48 and platforms 92, 94 therefore operate independently of one another and all are separately controlled by the controller 34. The drives for each platform 92, 94 extend through the center of door 48 and are carried in a position within base support 50 which is protected from the environment of treating chamber 36 by the mounting flange 54 and the seals 124 at the base of each platform 92, 94.

SPRAYING ASSEMBLY

Referring now to FIGS. 1, 7, 10 and 11, the mechanism for spraying material onto the parts 128 carried on the platforms 92 or 94 is illustrated in detail. For purposes of the present discussion, it is assumed that the parts 128 are to be cleaned of dirt, grease, burrs and the like with high pressure streams of water, steam or other cleaning solution. It is contemplated, however, that the blasting apparatus 10 of this invention could be employed to spray the parts 128 with sand, grit or a similar material. Alternatively, the blasting apparatus 10 could be utilized in a metallizing operation to apply a coating to the parts 128 as opposed to some type of cleaning material.

The spraying assembly herein comprises a sprayer support structure including a support column 246 connected between a pair of upright, vertical walls 247, 248, and a horizontal base support 249 which supports the vertical walls 247, 248. A pair of longitudinally extending rail followers 250, 252 are mounted on the underside of horizontal base support 249 and are slidable along a pair of rails 254, 256, respectively, mounted to the top 14 of cabinet 12. The bottom edge of support column 246 mounts a seal plate 258 movable in a pair of ways 260, 262 mounted on either side of a slot 264 formed in the top 14 of cabinet 12. As described below, the seal plate 258 is longitudinally movable with the support column 246 to cover the opening or slot 264 in cabinet 12 as the support column 246 moves therealong.

Figure 10:
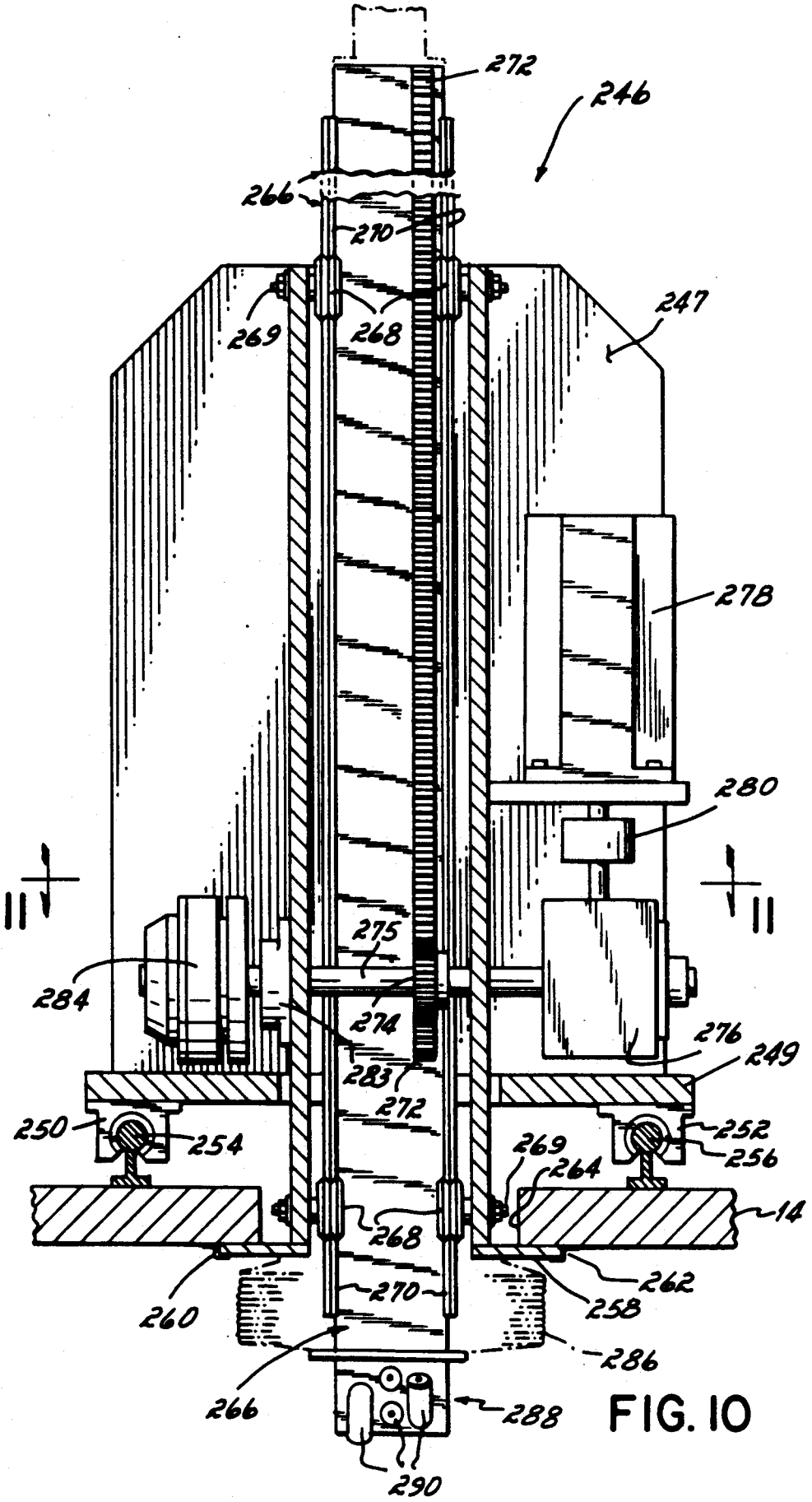
FIG. 10 is a cross sectional view of the reciprocating spray column as seen generally along lines 10—10 of FIG. 7.
Figure 11:
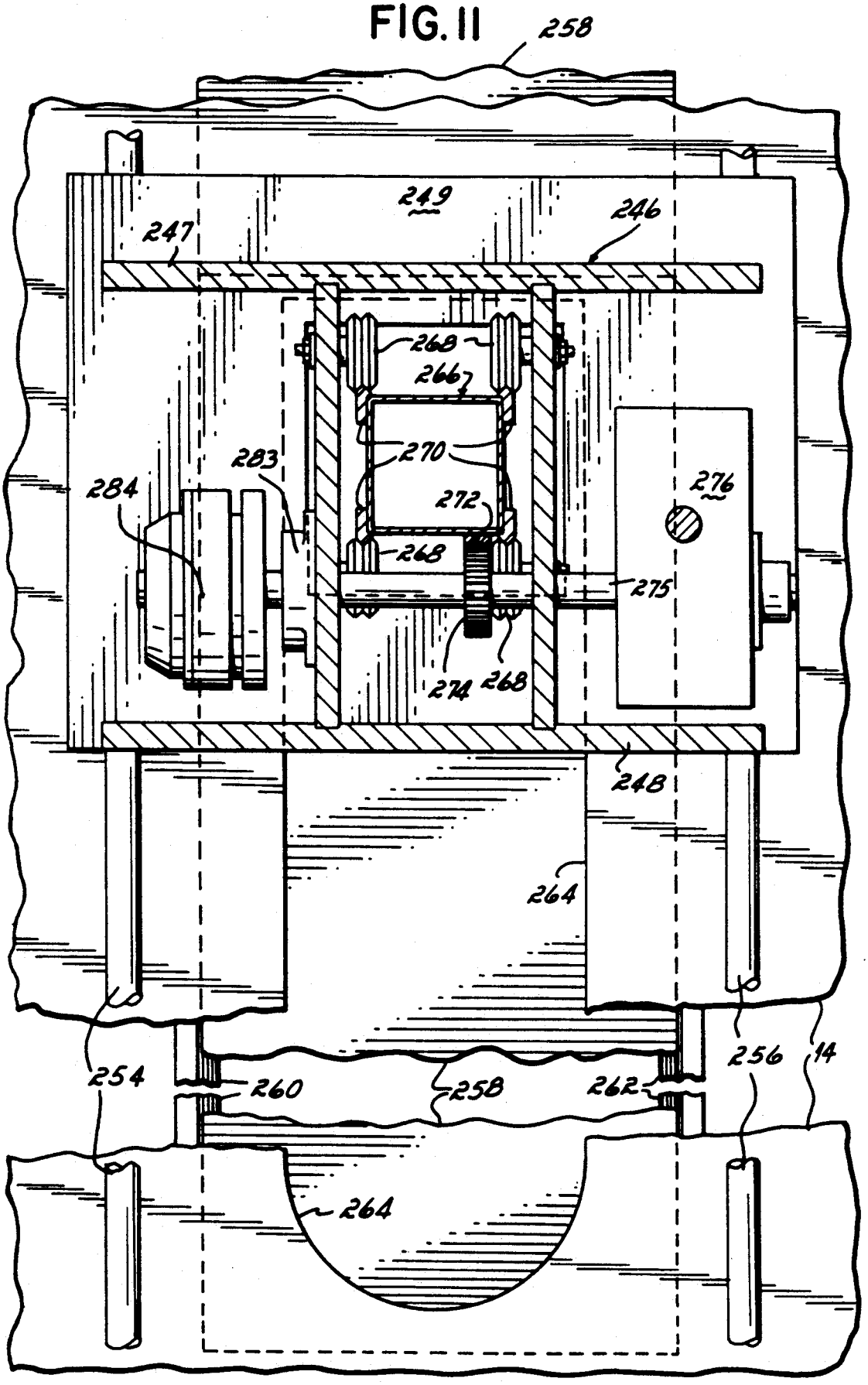
FIG. 11 is a cross sectional view taken along lines 11—11 of FIG. 10.

As best viewed in FIGS. 10 and 11, a vertically extending, square-shaped spray column 266 is carried within the support column 246 by a total of eight rollers 268. Four of the rollers 268 are mounted on shafts 269 connected near the top of the support column 246 at each corner of the spray column 266. The other four rollers 268 are mounted in a similar position at the base of support column 246, only two of which are shown in FIG. 10. Vertical rails 270 extend along the length of spray column 266 at the corners to engage the rollers 268 and ensure smooth movement therebetween.

A rack 272 is mounted vertically along a portion of the length of spray column 266 in a position to engage a pinion gear 274 mounted to the output shaft 275 of a right angle drive 276. The right angle drive 276 is connected to a servo-motor 278 by an anti-backlash coupling 280. The shaft 275 connected to the pinion gear 274 extends to the opposite side of the vertical support column 246, as viewed in FIGS. 10 and 11, where it is supported by a bearing 283 and then connected to a spring-engaged, air release brake 284.

Vertical movement of the spray column 266 with respect to the vertical support column 246 is accomplished as follows. In response to a signal from the controller 34, the servo-motor 278 is activated to drive the right angle drive 276 and pinion gear 274. The spray column 266 is moved vertically upwardly or downwardly relative to the support column 246 by the driving connection between pinion gear 274 and the rack 272. During such movement of the spray column 266, air is supplied to the brake 284 to cause it to release the shaft 275 and allow free rotation of the pinion gear 274. When the operation of servo-motor 278 is terminated by controller 34, air to the spring-engaged brake 284 is terminated and the spring-engaged brake is then operable to hold the shaft 275 and pinion gear 274 from rotation. This, in turn, prevents downward movement of the spray column 266 by gravity because of the connection between the now fixed pinion gear 274 and the rack 272 mounted on the spray column 266.

As shown in FIGS. 1 and 10, the base of spray column 266 mounts a bellows 286 which, in turn, mounts a spray head 288 having spray nozzles 290. The bellows 286 is connected at its upper end to the seal plate 258 such that upon downward movement of the spray column 266, the bellows 286 is extended downwardly carrying the spray head 288 with it. Lines connected to sources of steam, water, sand or the like (not shown) extend through the spray column 266, bellows 286 to the spray head 288.

The support column 246, vertical walls 247, 248, horizontal base support 249 and spray column 266 are all movable as a unit longitudinally atop the cabinet 12 by operation of a servo-motor 292. The output shaft 294 of motor 292 carries a worm gear 296 which meshes with a threaded shaft 298. The threaded shaft 298 is threaded into a bracket 300 mounted to the top 14 of cabinet 12 and then extends through a bellows 202 to the vertical support column 246.

In response to a signal from the controller 34, the motor 292 is activated to rotate the threaded shaft 298 and thus move the horizontal base support 248 along rails 254, 256 carrying the support column 246, vertical walls 247, 248 and spray column 266 therealong. As shown in FIGS. 7 and 11, the opening or slot 264 formed in the top 14 of cabinet 12 is required to permit longitudinal movement of the support column 246 and spray column 266 relative to the cabinet 12. In order to prevent the escape of spraying materials from treating chamber 36, the seal plate 258 functions to completely cover the slot 264 as it moves with support column 246 along ways 260, 262 regardless of the position of support column 246 along the slot 264.

While the invention has been described with reference to a preferred embodiment, it will be understood by those skilled in the art that various changes may be made and equivalents may be substituted for elements thereof without departing from the essential scope of the invention. In addition, many modifications could be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all claims.

I claim:

1. Apparatus for treating parts, comprising:

a cabinet having a treating chamber, said cabinet being formed with an opening into said treating chamber;

door means rotatably mounted to said cabinet within said opening to said treating chamber, said door means being formed with opposed sides;

at least one first part support platform mounted on one side of said door means, and at least one second part support platform mounted on the other side of said door means;

drive means connected between said cabinet and said door means for rotating said door means relative to said opening said cabinet, and for rotating said first and second part support platforms independently of one another relative to said door means, said drive means being effective to rotate said door means to position one of said first and second part support platforms within said treating chamber of said cabinet for the treatment of a part supported thereon, while said other of said first and second part support platforms is positioned outside of said treating chamber of said cabinet to permit removal of a treated part therefrom and placement of a part to be treated thereon;

means for treating a part supported on one of said first and second part support platforms within said treatment chamber.

2. The apparatus of claim 1 in which said cabinet has a top, a bottom and a side wall formed with said opening into said treating chamber, said door means comprising:

a hollow door having a bottom end, and a top end rotatably mounted to said top of said cabinet;

a base support connected to said bottom end of said hollow door and having first and second ends on opposite sides of said hollow door, said base support being rotatably mounted to said bottom of said cabinet;

said first end of said base support mounting of said first part support platform on one side of said hollow door, and said second end of said base support mounting said second part support platform on said other side of said hollow door.

3. The apparatus of claim 1 in which drive means comprises:

first means for rotating said door means relative to said cabinet;

second means for rotating said first part support platform relative to said door means;

third means for rotating said second part support platform relative to said door means;

said first, second and third means being operable independently of one another.

4. The apparatus of claim 3 in which said first means comprises:

a drive sprocket carried on said cabinet, said drive sprocket being driven by the output shaft of a first motor;

a follower sprocket, said follower sprocket being connected to a rotatable, outer drive sleeve mounted to said door means;

means drivingly interconnecting said drive sprocket and said follower sprocket to rotate said drive sleeve and said door means in response to operation of said motor.

5. The apparatus of claim 3 in which said second means comprises:

a drive sprocket carried by said cabinet;

means for drivingly connecting said drive sprocket to the output shaft of a second motor;

a rod extending from said cabinet through said door means, said rod being concentrically disposed within said outer rotatable drive sleeve mounted to said door means;

a first sprocket mounted at one end of said rod opposite said drive sprocket, and a second sprocket mounted at the other end of said rod;

a third sprocket mounted to said first part support platform opposite said second sprocket;

means for drivingly connecting said drive sprocket to said first sprocket for rotating said rod in response to operation of said motor;

means for drivingly connecting said second sprocket to said third sprocket to rotate said first part support platform with said rod relative to said door means.

6. The apparatus of claim 5 in which said means for drivingly connecting said drive sprocket to said second motor comprises:

a first clutch operatively connected to said drive sprocket;

a timing belt interconnecting said first clutch to said output shaft of said second motor.

7. The apparatus of claim 5 in which said third means comprises:

a drive sprocket carried by said cabinet;

means for drivingly connecting said drive sprocket to said output shaft of said second motor;

a rotatable, inner drive sleeve concentrically disposed about said rod of said second means and within said outer drive sleeve of said first means, said inner drive sleeve extending from said cabinet through said door means;

a fourth sprocket mounted at one end of said inner drive sleeve opposite said drive sprocket, and a fifth sprocket mounted at the other end of said inner drive sleeve;

a sixth sprocket mounted to said second part support platform opposite said fifth sprocket;

means for drivingly connecting said drive sprocket to said fourth sprocket to rotate said inner drive sleeve in response to operation of said motor;

means for drivingly connecting said fifth sprocket to said sixth sprocket to rotate said second part support platform with said inner drive sleeve relative to said door means.

8. The apparatus of claim 5 in which said means for drivingly connecting said drive sprocket to said second motor comprises:

a second clutch operatively connected to said drive sprocket;

a timing belt interconnecting said second clutch to said output shaft of said second motor.

9. The apparatus of claim 1 further including locking means for locking each of said part support platforms from rotation relative to said door means, each of said locking means comprising:

a first cylinder mounted to said door means beneath said part support platform, said cylinder having a first piston carrying a locking pin, said piston and said locking pin being movable between an extended position and a retracted position;

first means for moving said first piston and said locking pin to said extended position wherein said locking pin contacts the underside of said part support platform, said underside of said part support platform being formed with an opening to receive said locking pin which extends therein to lock said part support platform from rotation relative to said door means;

second means for moving said first piston and said locking pin from said extended, locking position to said retracted position wherein said locking pin disengages said opening in the underside of said part support platform.

10. The apparatus of claim 9 in which said second means comprises:

a second cylinder mounted within said treating chamber of said cabinet, said second cylinder having a second piston carrying a hollow tube, said second piston and said hollow tube being movable between an extended position and a retracted position;

an air line connected between said first cylinder mounted to said door means and a port formed in said door means;

means for moving said second piston and said hollow tube between said extended position and said retracted position, said hollow tube being engageable in said extended position with said port formed in said door means, said hollow tube and said air line forming an air path for transmitting pressurized air to said first cylinder to move said first piston and said locking pin to said retracted, unlocked position.

11. Apparatus for treating parts, comprising:

a cabinet having an outer wall defining a treating chamber, said outer wall being formed with an opening into said treating chamber;

door means rotatably mounted to said cabinet within said opening in said outer wall, said door means being formed with opposed sides;

at least one first part support platform mounted to one side of said door means, and at least one second part support platform mounted to the other side of said door means;

drive means connected between said cabinet and said door means for rotating said door means between an open position and a closed position relative to said opening in said cabinet, and for rotating said first and second part support platforms independently of one another relative to said door means, said drive means being effective to rotate said means to position one of said first and second part support platforms within said treating chamber of said cabinet for the treatment of parts supported thereon, while said other of said first and second part support platforms is positioned outside of said treating chamber of said cabinet to permit removal of treated parts therefrom and placement of parts to be treated thereon;

means for treating a part supported on one of said first and second part support platforms within said treatment chamber;

sealing means carried by one of said door means and said outer wall of said cabinet at said opening to said treating chamber for sealing said opening in said cabinet with said door means in said closed position.

12. The apparatus of claim 11 in which said sealing means comprises:

an inflatable, flexible member carried on said outer wall of said cabinet around the periphery of said opening into said treating chamber, said flexible member being movable between an unextended, retracted position and an inflated, expanded position in which said flexible member sealingly engages the outer periphery of said door means to form a fluid-tight seal thereat;

means for inflating said flexible member.

13. The apparatus of claim 11 in which said sealing means comprises:

an inflatable, flexible member carried on the outer periphery of said door means, said flexible member being movable between an unextended, retracted position and an inflated, expanded position in which said flexible member sealingly engages said outer wall of said cabinet around the periphery of said opening therein to create a fluid-tight seal thereat;

means for inflating said flexible member.

14. The apparatus of claim 13 in which said means for inflating said flexible member comprises:

a cylinder mounted to said outer wall of said cabinet, said cylinder having a piston carrying a hollow tube, said piston and said hollow tube being movable between an extended position and a retracted position;

an air passageway formed in said door means, said air passageway having a port at one end and an opposite end connected to said inflatable, flexible member;

means for moving said piston and said hollow tube between said extended and retracted positions, said hollow tube being engageable in said extended position with said port of said air passageway in said door means, said hollow tube and said air passageway forming an air path for transmitting pressurized air to said flexible member to inflate said flexible member.

15. Apparatus for spraying flowable material onto a part, comprising:

a cabinet having a treating chamber, said cabinet being formed with an opening into said treating chamber;

door means rotatably mounted to said cabinet within said opening to said treating chamber, said door means being formed with opposed sides;

at least one first part support platform mounted on one side of said door means, and at least one second part support platform mounted on the other side of said door means;

drive means connected between said cabinet and said door means for rotating said door means relative to said opening in said cabinet, and for rotating said first and second part support platforms independently of one another relative to said door means, said drive means being effective to rotate said door means to position one of said first and second part support platforms within said treating chamber of said cabinet for the treatment of parts supported thereon, while said other of said first and second part support platforms is positioned outside of said treating chamber of said cabinet to permit removal of treated parts therefrom and placement of parts to be treated thereon;

spray means for spraying a flowable material onto a part supported on one of said first and second part support platforms within said treatment chamber;

means for moving said spray means relative to a part carried on one of said first and second part support platforms therein.

16. The apparatus of claim 15 in which said cabinet has a top wall formed with a longitudinally extending slot, said spray means comprising:

a vertically extending spray column having an upper end and a lower end, said spray column being movable along said longitudinal slot in said cabinet and vertically relative to said top wall therein;

a spray head carried on said lower end of said spray column, said spray head mounting at least one spray nozzle for spraying flowable material onto a part within said treating chamber;

bellows connected between the underside of said top wall of said cabinet and said spray head, said bellows being extensible and retractable with the vertical movement of said spray column within said treating chamber.

17. The apparatus of claim 16 in which said means for moving said spray means comprises:

a vertically oriented support column mounted atop said cabinet, said support column having an upper end, a lower end and a hollow interior;

roller means mounted to said upper end and to said lower end of said support column within said hollow interior thereof;

said spray column being received within said hollow interior of said support column and having vertically extending rails mounted thereto for slidingly engaging said roller means of said support column;

vertical drive means drivingly connected between said support column and said spray column for moving said spray column vertically within said treating chamber relative to said support column.

18. The apparatus of claim 17 in which said vertical drive means comprises:

a rack mounted to said spray column;

a pinion gear carried by said support column, said pinion gear being drivingly connected to said rack;

a motor drivingly connected to said pinion gear; and a brake connected to said pinion gear for preventing vertical movement of said spray column when said motor is not operating.

19. The apparatus of claim 16 in which said means for moving said spray column comprises:

a horizontal base for mounting said support column;

a pair of longitudinally extending rails mounted to said top wall of said cabinet on opposite sides of said slot therein, said horizontal base having a pair of rail followers engageable with said rails for movement therealong;

longitudinal drive means carried atop said cabinet for moving said horizontal base and said support column longitudinally along said rails, said spray column being longitudinally movable with said support column within said treating chamber relative to a part support therein.

20. The apparatus of claim 19 further including a sealing plate mounted to the lower end of said support column, said sealing plate extending across the width of said slot formed in said top wall of said cabinet and being longitudinally movable with said support column to cover said slot regardless of the position of said support column relative to said cabinet.

21. Apparatus for spraying flowable material onto a part, comprising:

a cabinet having an outer wall defining a treating chamber, said outer wall being formed with an opening into said treating chamber;

door means rotatably mounted to said cabinet within said opening in said outer wall, said door means being formed with opposed sides;

at least one first part support platform mounted to one side of said door means, and at least one second part support platform mounted to the other side of said door means;

drive means connected between said cabinet and said door means for rotating said door means between an open position and a closed position relative to said opening in said cabinet, and for rotating said first and second part support platforms independently of one another relative to said door means, said drive means being effective to rotate said door means to position one of said first and second part support platforms within said treating chamber of said cabinet for the treatment of parts supported thereon, while said other of said first and second part support platforms is positioned outside of said treating chamber of said cabinet to permit removal of treated parts therefrom and placement of parts to be treated thereon;

spray means for spraying a flowable material onto a part supported on one of said first and second part support platforms within said treatment chamber;

means for moving said spray means relative to a part carried on one of said first and second part platforms; and sealing means carried by one of said door means and said outer wall of said cabinet at said opening to said treating chamber for sealing said opening in said cabinet with said door means in said closed position.

* * * * *